US005242313A

United States Patent [19]

Logerot et al.

[11] Patent Number: 5,242,313

[45] Date of Patent: Sep. 7, 1993

[54] CONNECTION ASSEMBLY BETWEEN A COMMON MULTICONDUCTOR BUNDLE AND A BRANCHED MULTICONDUCTOR BUNDLE

[75] Inventors: Bernard Logerot, Santans; Didier Poyet; Remy Pone, both of Dole, all of France

[73] Assignee: Amphenol Socapex, France

[21] Appl. No.: 779,864

[22] Filed: Oct. 21, 1991

[51] Int. Cl.[5] ..... H01R 4/24

[52] U.S. Cl. ..... 439/404

[58] Field of Search ..... 439/389–425

[56] References Cited

U.S. PATENT DOCUMENTS

| | | | |
|---|---|---|---|
| 3,924,917 | 12/1975 | Munshower | 339/17 |
| 3,956,811 | 5/1976 | Munshower | 29/203 |
| 4,263,474 | 4/1981 | Tannant | 174/84 |
| 4,564,256 | 1/1986 | Damiano et al. | 439/404 |
| 4,668,039 | 5/1987 | Marzili | 439/404 |
| 4,674,819 | 6/1987 | Fujitani et al. | 439/404 |
| 4,687,275 | 8/1987 | Ramisch et al. | 439/404 |
| 4,968,267 | 11/1990 | Payne | 439/404 |

*Primary Examiner*—Joseph H. McGlynn
*Attorney, Agent, or Firm*—Bacon & Thomas

[57] ABSTRACT

Electrical connection assembly between a control bundle (25) having n conductors ($C_1$–$C_n$) and at least one branched bundle (30) having n conductors ($D_1$–$D_n$), one at least of the conductors ($D_3$) of the branched bundle being connected in parallel with one of the conductors ($C_3$) of the control bundle, and two of the conductors of the branched bundle ($D_1$–$D_2$) being connected in series with one of the conductors ($C_2$) of the control bundle.

This assembly comprises a first clip (100) for fastening and connection on the control bundle (25), which clip is equipped with at least one contact ($F_3$) ensuring an electrical contact with the conductor of the control bundle to be connected in parallel, at least one disconnection member (108) for disconnecting the conductor to be connected in series and at least two contacts ($F_1$,$F_2$) for ensuring electrical contacts on either side of the disconnection member with the conductor ($C_2$) to be connected in series.

13 Claims, 8 Drawing Sheets

CONNECTION ASSEMBLY BETWEEN A COMMON MULTICONDUCTOR BUNDLE AND A BRANCHED MULTICONDUCTOR BUNDLE

This application is a continuation of International patent application No. PCT/FR90/00120 filed Feb. 20, 1990, designating the United States of America.

The present invention relate to a connection assembly between a common multiconductor bundle and a branched multiconductor bundle, a pair of conductors in each bundle being required to perform a "series" check of the connection.

In many applications, the problem arises of branching a certain number of apparatuses, a large number sometimes, on a common multiconductor bundle issuing from a control unit.

For simple connections in parallel between the conductors of the common bundle and the conductors of the branched bundle, many solutions exist already using, for example, bundles in cable ribbon form and connectors with insulation piercing teeth for clamping on the cable ribbon. FR-A-2 269 798 and EP-A-0 020 031 describe such systems.

The underlying problem in the present invention is that of the connection whenever two of the conductors of the common bundle are required to perform a series connection control, for which the techniques of connectors clippable on a cable ribbon bring no solution.

It is the object of the present invention to solve this particular problem by providing an electrical connection assembly between a control bundle of n conductors, and at least one branched bundle of n conductors, one at least of the conductors of the branched bundle being connected in parallel with one of the conductors of the control bundle and two of the conductors of the branched bundle being connected in series with one of the conductors of the control bundle, characterized in that said assembly comprises a first clip for fastening and connection on the control bundle, which clip is equipped with at least one contact ensuring an electrical contact with the conductor of the control bundle to be connected in parallel, at least one disconnection member for disconnecting the conductor to be connected in series and at least two contacts for ensuring electrical contacts on either side of the disconnection member with the conductor to be connected in series.

The details and advantages of the invention will be more readily understood on reading the following description with reference to the accompanying drawings in which.

Figure 1:
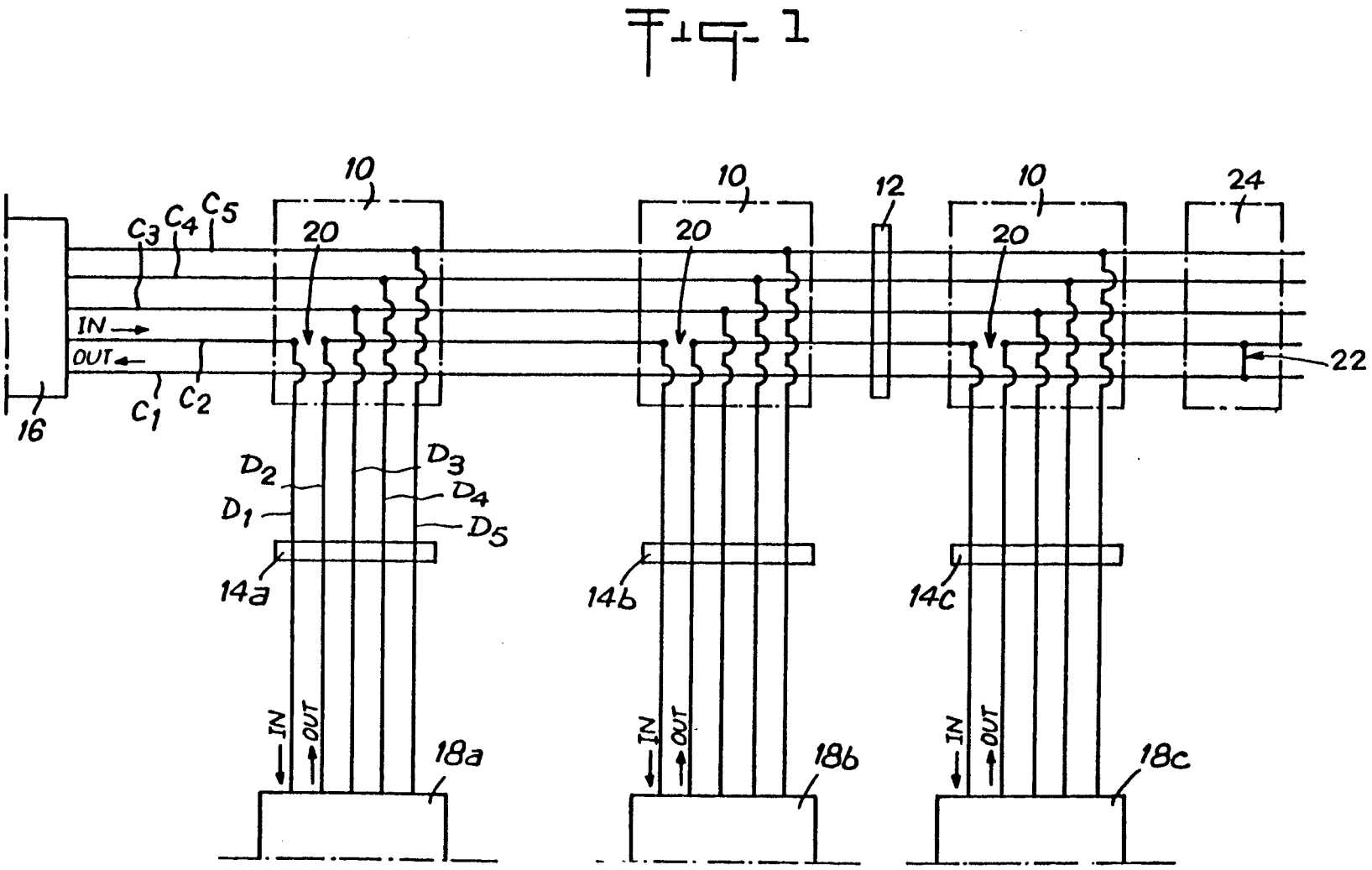
FIG. 1 is a connection diagram depicting a connection between a common multiconductor bundle and branched bundles.

As diagrammatically illustrated in FIG. 1, the object of this invention is to provide electrical connection assemblies 10 between a common multiconductor control bundle 12 and branched multiconductor bundles 14*a*, 14*b*, 14*c*, etc., which are simple and economical to produce without any risk of errors.

This type of network is designed to connect one control unit 16, from which the common bundle is issued, with a plurality of apparatuses 18*a*, 18*b*, 18*c*, etc., where the branched bundles end.

The common bundle comprises n conductors, 5 in the illustrated example, i.e. $C_1$, $C_2$, $C_3$, $C_4$ and $C_5$, two of which, $C_1$ and $C_2$, are adapted for a "series" connection control of all the apparatuses 18, the other conductors $C_3$, $C_4$, $C_5$ serving for conveying analog or digital control instructions to the apparatuses for a connection "in parallel".

To this effect, each branched bundle also has n conductors, the first two $D_1$ and $D_2$ being connected to the conductor $C_2$ of the common bundle on either side of a disconnection 20 in said bundle, and the next three $D_3$, $D_4$, $D_5$ being respectively connected to conductors $C_3$, $C_4$, $C_5$ of the common bundle.

Conductor $C_1$ of the common bundle is adapted to return the "series" connection achieved as indicated hereinabove, on conductor $C_2$. To this effect, conductors $C_1$ and $C_2$ are interconnected by a short-circuit 22 at their end opposite the control unit, through a terminal connection assembly 24 which is also part of the invention and to be described hereinafter.

Figure 2:
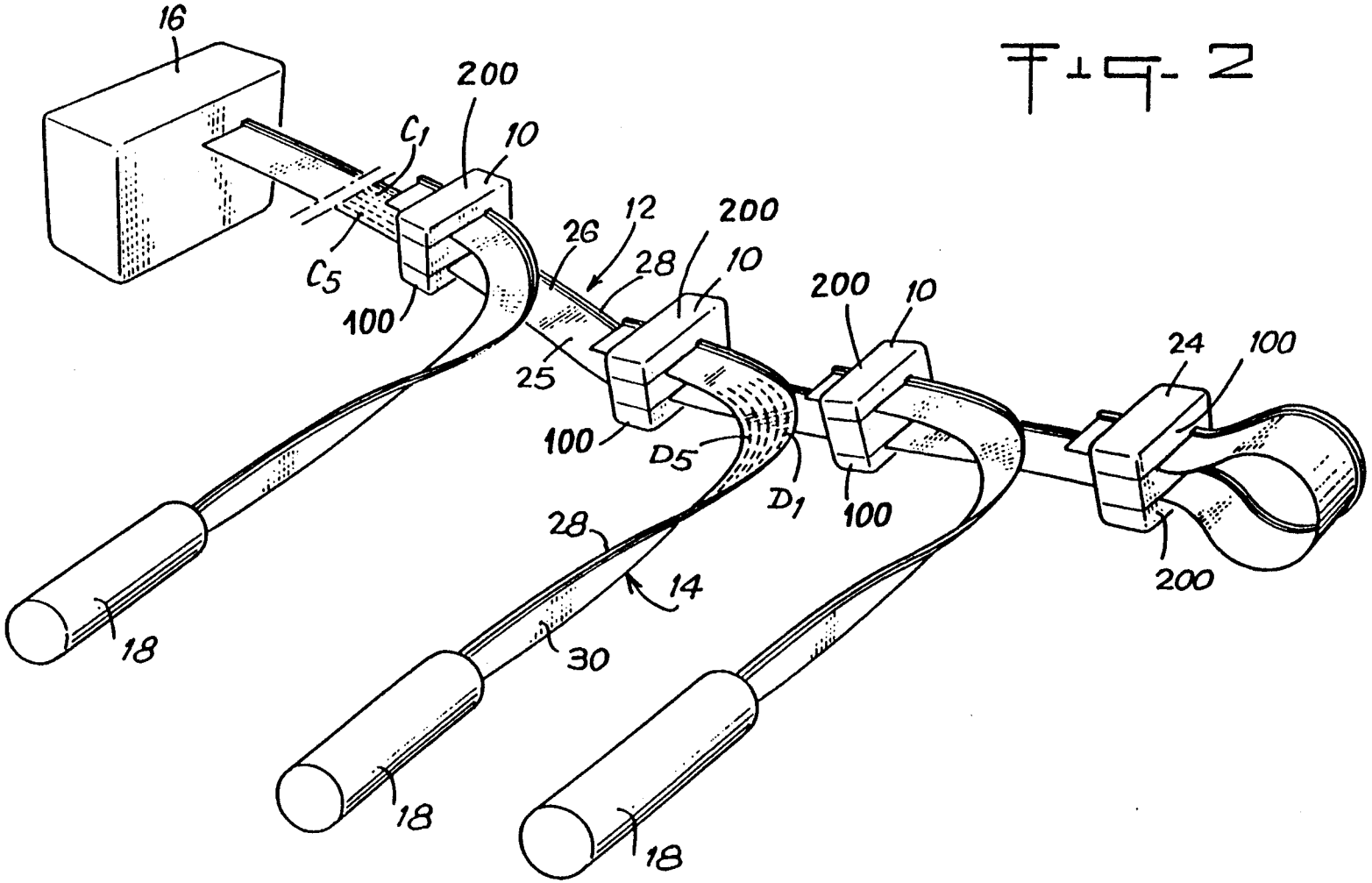
FIG. 2 is an overall illustration of the connection assemblies according to the invention.

As illustrated in FIG. 2, the common multiconductor bundle 12 is produced in the form of a cable ribbon 25 with n parallel conductors, said cable ribbon being equipped on one of its edges with polarizing means 26, which, according to the invention, are advantageously constituted by a lateral rib 28 thicker than the cable ribbon. The extra thickness may project on one face only, or preferably on both faces. As a variant, the polarizing means may simply consist in a visual indication, such as a lateral strip of a different color from that of the cable ribbon.

The conductors of the cable ribbon are thus indexed from the lateral rib 28, conductor $C_1$ being closest and conductor $C_5$ being farthest.

Similarly, the branched bundles 14 are in the form of a cable ribbon 30 of similar or preferably identical structure, their conductors $D_1$–$D_5$ being indexed in the same way with respect to the lateral rib 28.

It is of course understood that for bundles with n conductors the foregoing enumerations will be expressed as $C_1 \ldots C_n$ and $D_1 \ldots D_n$.

Each connection assembly 10 is constituted of two clips 100 and 200, respectively assembled on the cable ribbon of the main bundle and on the cable ribbon of the branched bundle as will be described with reference to FIGS. 3 to 8.

Figure 3:
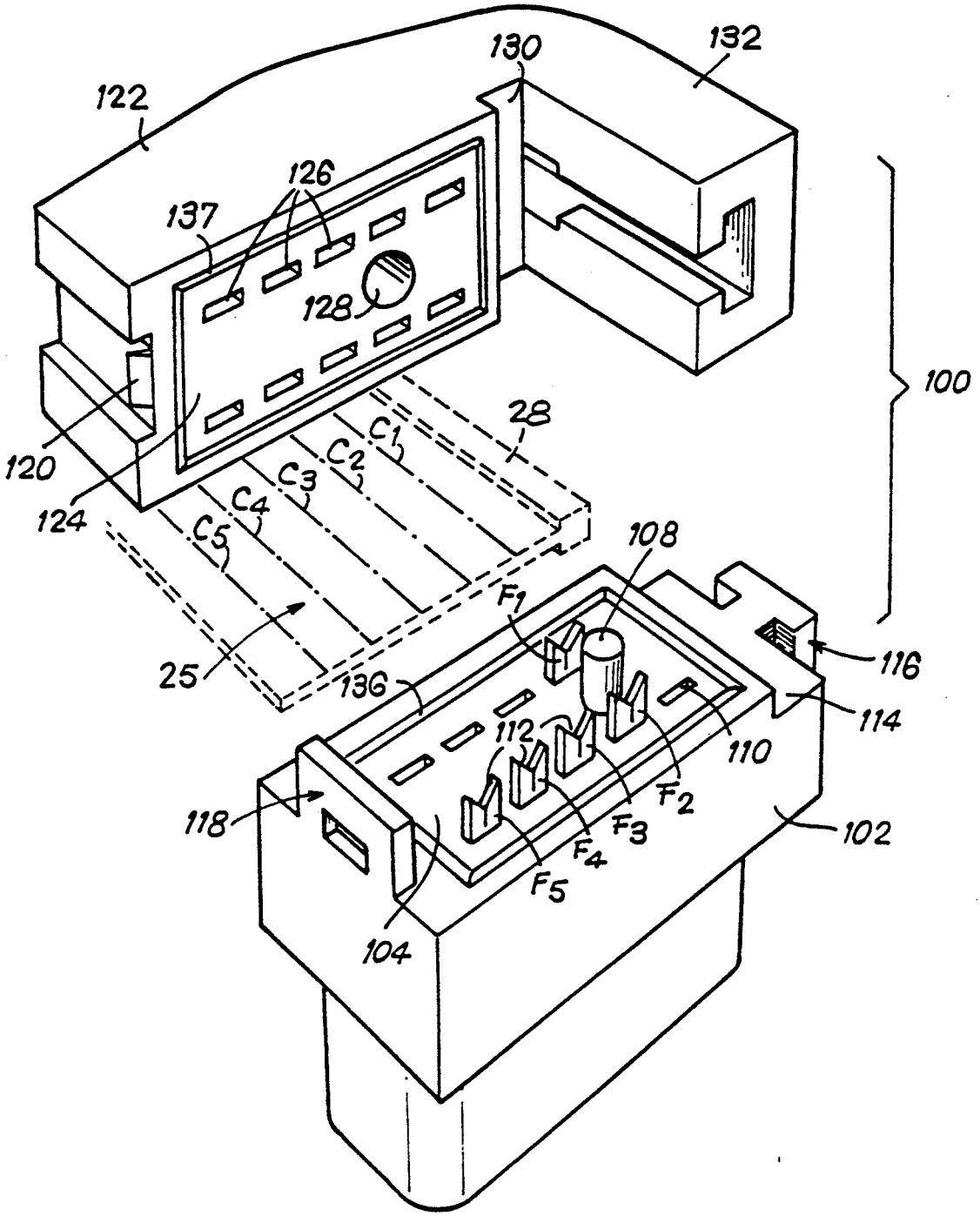
FIGS. 3 and 4 are detailed views of a connector clip forming part of the invention.
Figure 4:
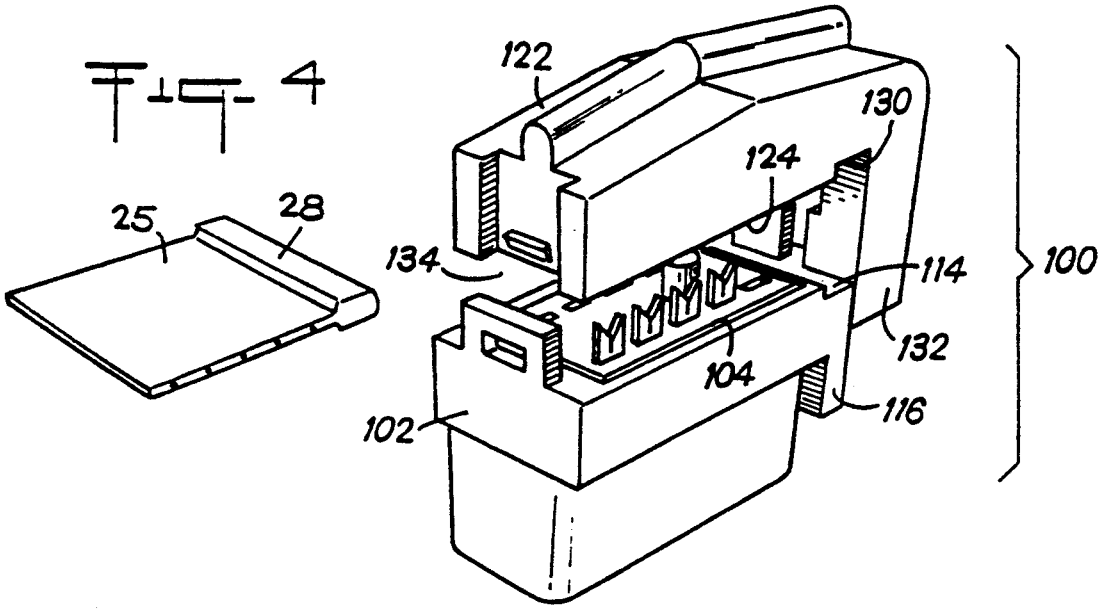

The first clip 100 destined to the main bundle, and illustrated in FIGS. 3 and 4, comprises a base 102 in insulating material, having a substantially flat upper face 104 from which project a number of contacts and a punching or disconnecting member 108.

The contacts are metallic pieces to be described in more detail with reference to FIG. 9. They are received in housings 110 provided in the base substantially perpendicularly to the upper face 104. Only their active ends 112, provided with two sharp points, protrude from the upper face; these are designed to set up a contact with the conductors of the cable ribbon 25 by piercing the insulation.

The upper face 104 of the base comprises a peripheral strip 136, slightly protruding and adapted to penetrate the insulation of the cable ribbon in order to ensure tightness as will be seen hereinafter.

At one end of the upper face 104, the base comprises a step 114 adapted to receive the lateral rib 28 of the cable ribbon 25. Said base is extended beyond the step 114 by a guiding member 116 extending perpendicularly to the upper face.

In the illustrated example, the guiding member has a male contour of T-shaped cross-section, but of course many other variants are also suitable.

At the other end of the upper face 104, the base is provided with a protruding hook 118, adapted to act as a holding member for a catch 120 provided on a cover 122, which will now be described.

The cover 122, also made from insulating material, has a substantially plane lower face 124, provided with recesses 126, 128 adapted to receive respectively the sharp ends of the contacts and the head of the punching member 108.

The lower face 124 of the cover also comprises a peripheral insulating strip 137.

The catch 120 protrudes laterally with respect to the cover, at one end of the cover.

At the other end of the lower face 124, the cover also comprises a step 130 adapted to receive the laterl rib of the cable ribbon 25. The cover is extended beyond this step, by a guiding member 132 which extends perpendicularly to the lower face and is complementary to the guiding member 118 of the base. In the illustrated example, guiding member 132 has a female contour of T-shaped cross-section.

In FIG. 4, the cover 122 is partly fitted over the base 102 by mutual engagement of their respective guiding members 116, 132, in such a wa as to leave between their upper 104 and lower 124 faces, a space 134 through which the cable ribbon 25 can be laterally introduced.

Figure 7:
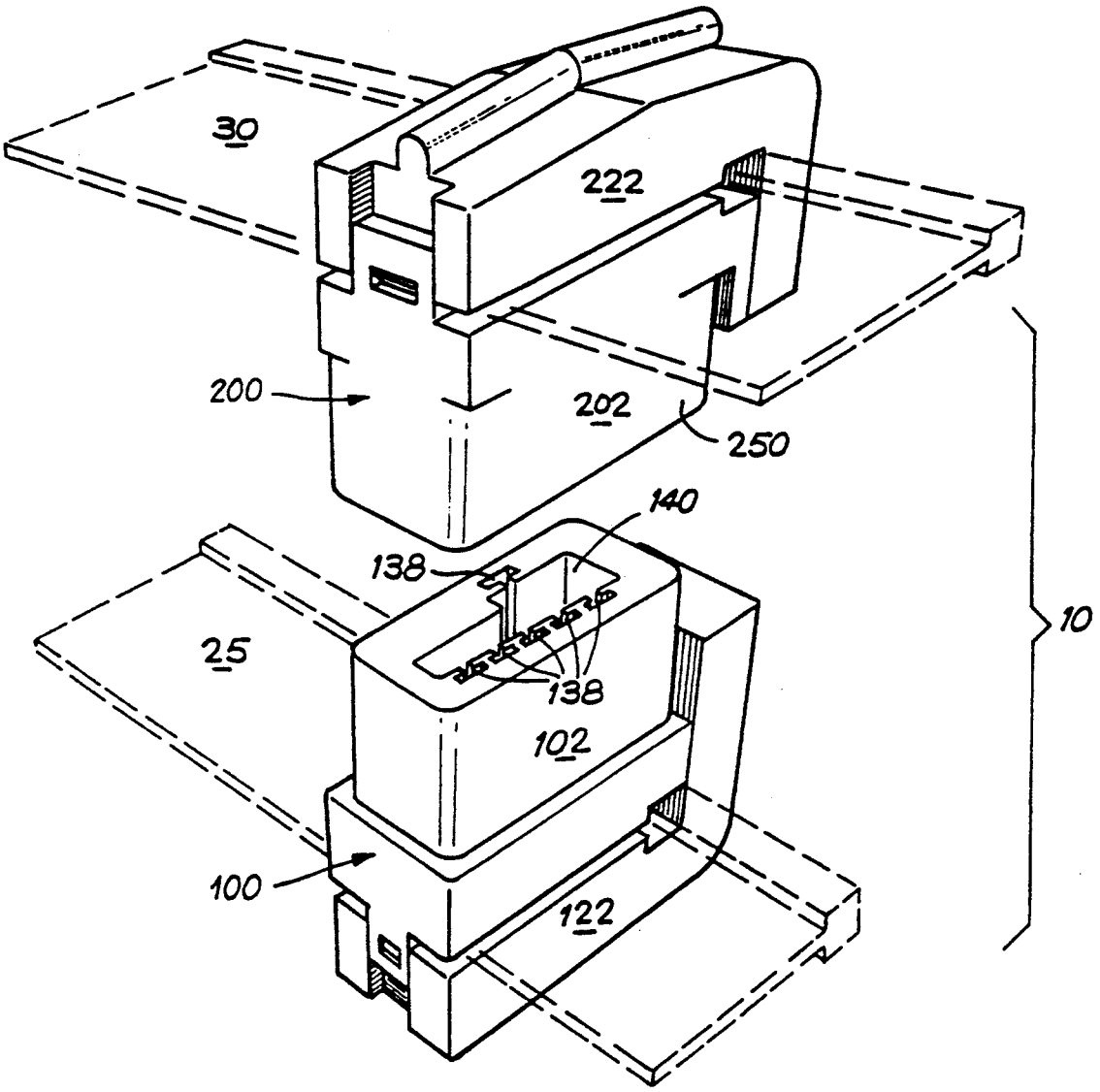
FIGS. 7 and 8 illustrate in detail how the clips shown in FIGS. 3 to 6 are fitted.
Figure 8:
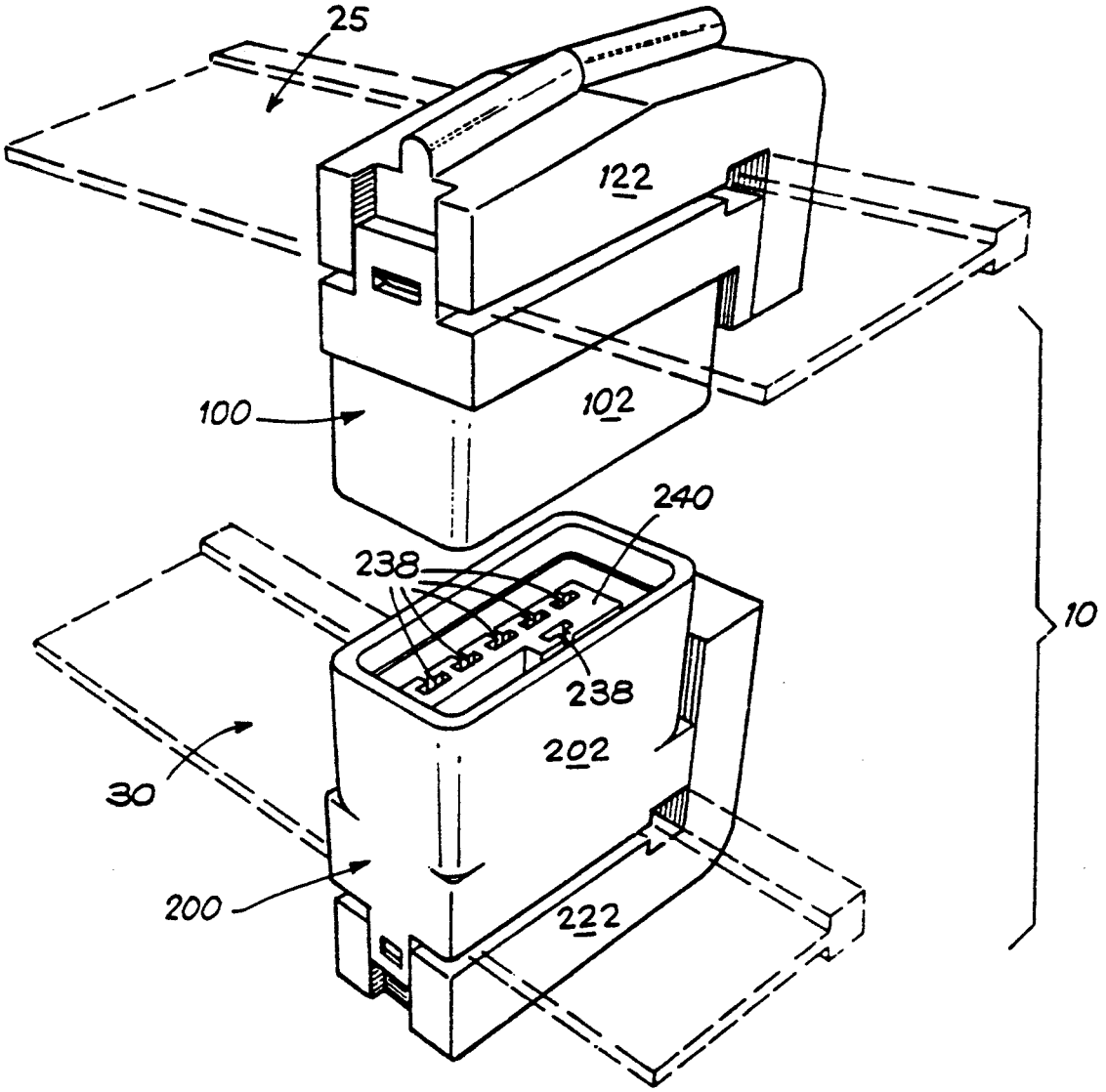

The base and the cover are then brought closer together until their plane faces 104, 124 or their insulation strips (136, 137) contact with the faces of the cable ribbon, as illustrated in FIGS. 7 and 8, the lateral rib of extra thickness of the cable ribbon being received in steps 114 and 130.

It is therefore obviously impossible to clamp the two parts of the clip together, if the lateral rib of the cable ribbon is presented on the wrong side.

Indeed, said lateral rib will create an obstacle between the plane faces 104, 124 of the base and of the cover, close to the hook 118 and catch 120, and prevent the base and the cover from being brought closer together.

When the two parts are clamped together, the sharp points of the contacts pierce the insulation of the cable ribbon in order to come into contact with the conductors, without splitting them.

When the base and the cover are clamped about the cable ribbon, they remain in that position due to the catch 120 being hooked under hook 118. Complementarily, a hooking arrangement will advantageously be provided o the side of the guiding members 116, 132, as obvious to anyone skilled in the art and therefore not described herein.

Referring once more to FIG. 3, this shows that the contacts are arranged in two rows perpendicular to the step 114, hence to the cable ribbon.

The first row is composed of four contacts $F_5$, $F_4$, $F_3$ and $F_2$, placed at decreasing distances with respect to step 114, so that said contacts come in exactly corresponding position with respect to conductors $C_5$, $C_4$, $C_3$ and $C_2$ of the cable ribbon 25.

The second row contains only one contact $F_1$, placed at the same distance from the step 114 as the contact $F_2$, therefore also in a corresponding position with respect to conductor $C_2$ of the cable ribbon 25.

The punching member 108 is situated between the two contacts $F_1$ and $F_2$.

Accordingly, when the base 102 and the cover 122 of the clip 100 are joined together and clamped, the punching member punches the cable ribbon facing conductor $C_2$ and causes a disconnection of the latter, whereas the two contacts $F_1$, $F_2$ are brought into electrical contact with said conductor $C_2$ on either side of said disconnection.

Understandably, the punching head should be produced in an insulating material or, at least, covered with such a material.

The contacts are extended towards the lower part of the base as described hereinafter.

Figure 6:
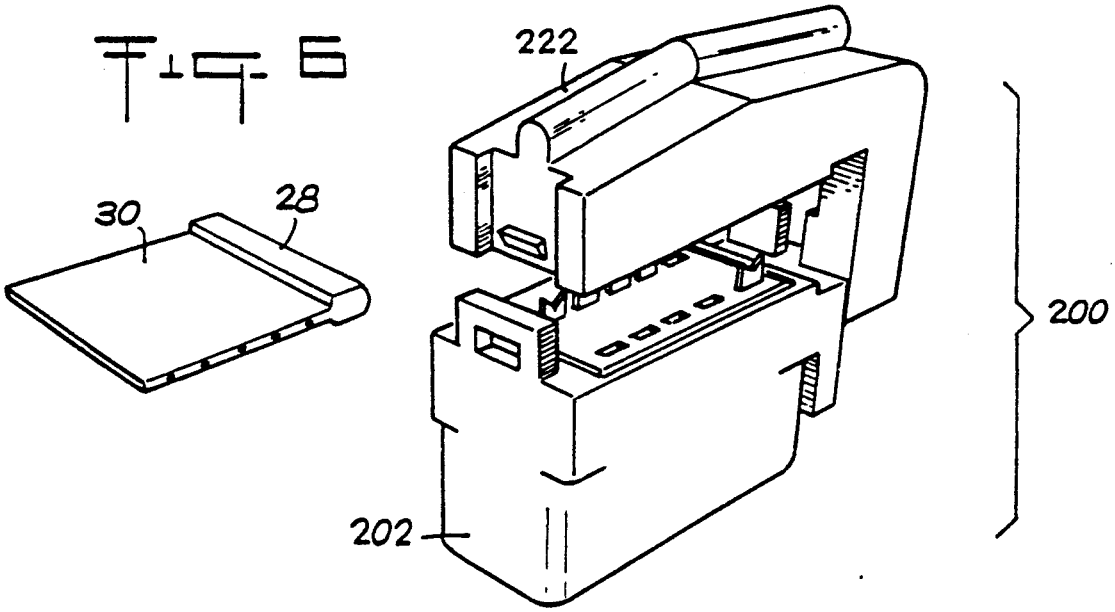
FIGS. 5 and 6 are detailed views of a second connector clip forming part of the invention.
Figure 5:
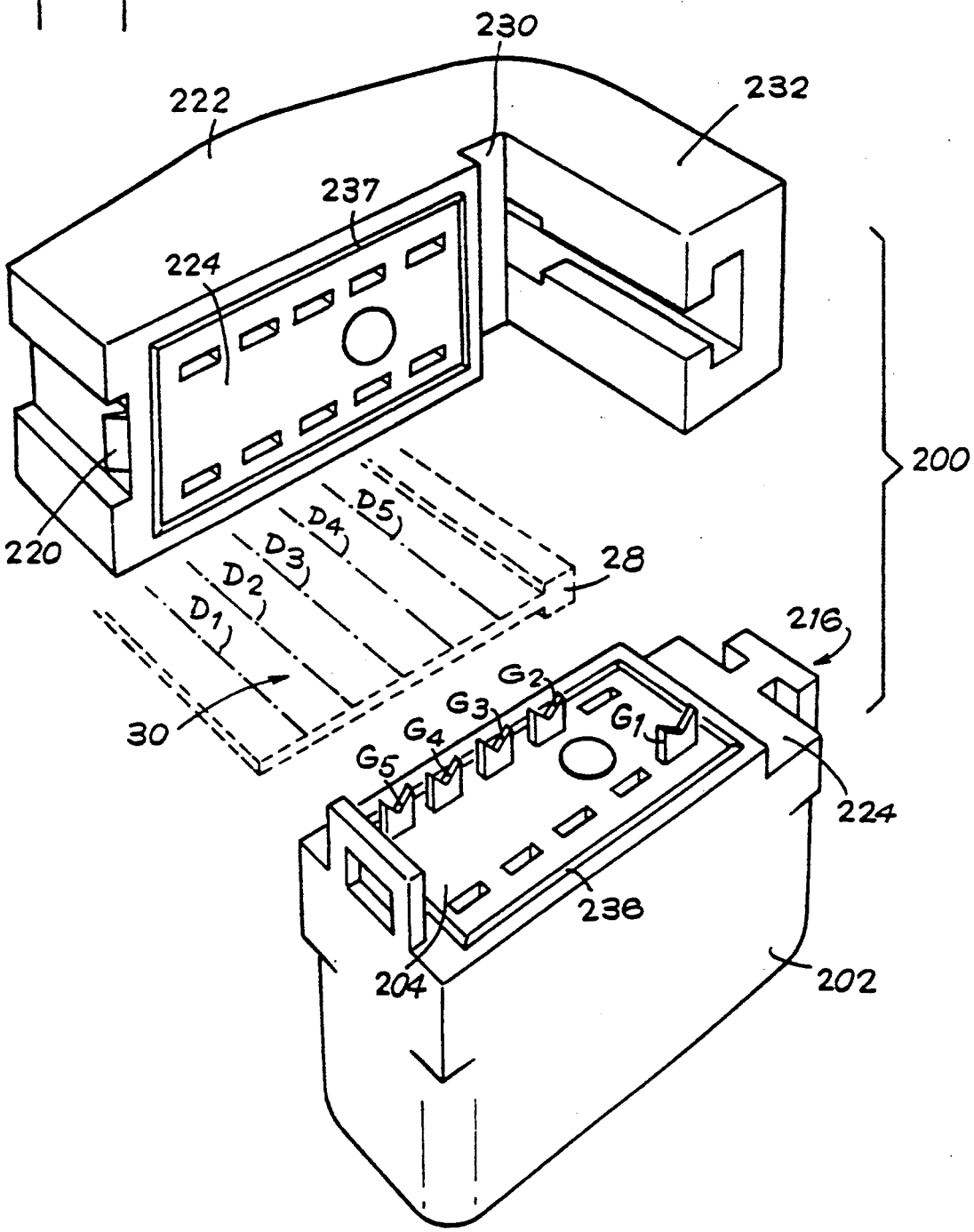

The second clip 200 illustrated in FIGS. 5 and 6, which is destined to the branched bundle, is constructionally similar to the first clip and its corresponding components will have the same reference numerals incremented by a value of 100.

Essentially, this second clip only differs from the first by the disposition of its contacts and by the shape of the lower part of the base 202.

Contacts $G_5$, $G_4$, $G_3$ and $G_2$ are, in this case, arranged in the second row, in facing relationship to conductors $D_5$, $D_4$, $D_3$ and $D_2$ of the cable ribbon 30; contact $G_1$ is on its own on the first row in facing relationship to conductor $D_1$ and the base has no punching member.

The cover 222 is identical.

FIGS. 7 and 8 show the second clip 200 clamped about the branched cable ribbon 30.

Said figures also illustrate the complementary engageable shapes of the bases 102 and 202.

The base 102 is of female type and comprises an inner cavity 140 bordered with grooves 138 open inwards of said cavity, in which grooves are received the tail ends of the contacts 106.

The base 202 is of male type and comprises a unit 240 on the periphery of which are provided outwardly open grooves 238 in which are received the contacts ends.

When unit 240 of base 202 is received in cavity 140, the grooves 138 and 238 are in corresponding position so that the contact ends 304 can be applied one against the other laterally. An external skirt 250 ensures insulation of the connection.

Figure 9:
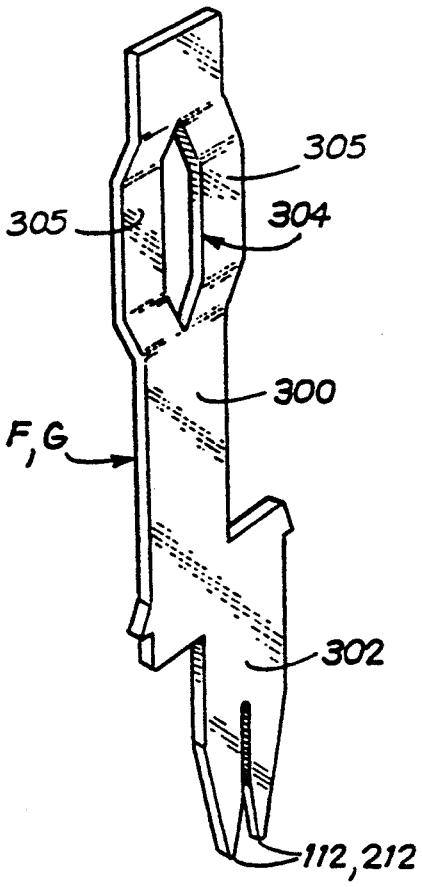
FIG. 9 is a detailed view of a connector contact.

More specifically, FIG. 9 shows a perspective view of the shape of an individual contact F or G.

Such a contact is obtained by punching/stamping a strip of metal 300.

Its head part 302 which carries the sharp ends 112, 212 and its connecting end 304 are offset one from the other by a distance equal to half the pitch P of the conductors of the cable ribbons. End 305 comprises laterally protruding bosses 305.

As diagrammatically illustrated in cross-section in FIG. 10, the two bosses are designed in such a way that the ends 304 of the contacts 300 are offset with respect to the conductors of the cable ribbons, as follows:

In the base 102 of the clip 100, the four ends of contacts $F_5$, $F_4$, $F_3$ and $F_2$ are offset towards the lateral rib 28 of the cable ribbon 25, as well as the end of contact $F_1$ situated in the second row and for this reason illustrated in dotted lines in the figure.

In the base 202 of the clip 200, the ends of contacts $G_5$, $G_4$, $G_3$ and $G_2$ are likewise offset towards the lateral rib, whereas the end of contact $G_1$ which is situated in the second row is offset in the opposite direction.

Accordingly, when two bases are engaged one into the other, contacts $F_1$ to $F_5$ are under electrical conduction with contacts $G_1$ to $G_5$, due to the bosses of their respective ends, thereby making up the diagram of FIG. 1.

It is worth noting that the connection assembly according to the invention is particularly simple, lightweight, and economical to produce and to use.

The two clips which make this assembly are small-sized, since indeed, a cable ribbon with 5 conductors spaced for example at a pitch of one tenth of an inch, i.e. 2.54 mm, has a total width of less than 0.63 inch or 16 mm, including the lateral rib and extra thickness. Obviously, this width may be smaller if the selected pitch is less.

The covers are identical and only the two bases differ, so that three molds are sufficient to produce them.

Similarly, all the contacts are identical and can easily be produced on continuous machines.

The clips may be furnished pre-assembled, in which case they only require clamping after the introduction of the cable ribbon between the cover and the base, a simple clamping tool being used, advantageously a hand tool.

It should be noted finally that the same assembly can be used for producing the terminal connector 24.

Indeed, referring appropriately to FIG. 2, a clip identical to the clip 200 described above will be fixed close to the end of the cable ribbon 25 of the control bundle, and a clip identical to clip 100 at a short distance from the former, both clips being thereafter engaged one over the other.

Figure 10:
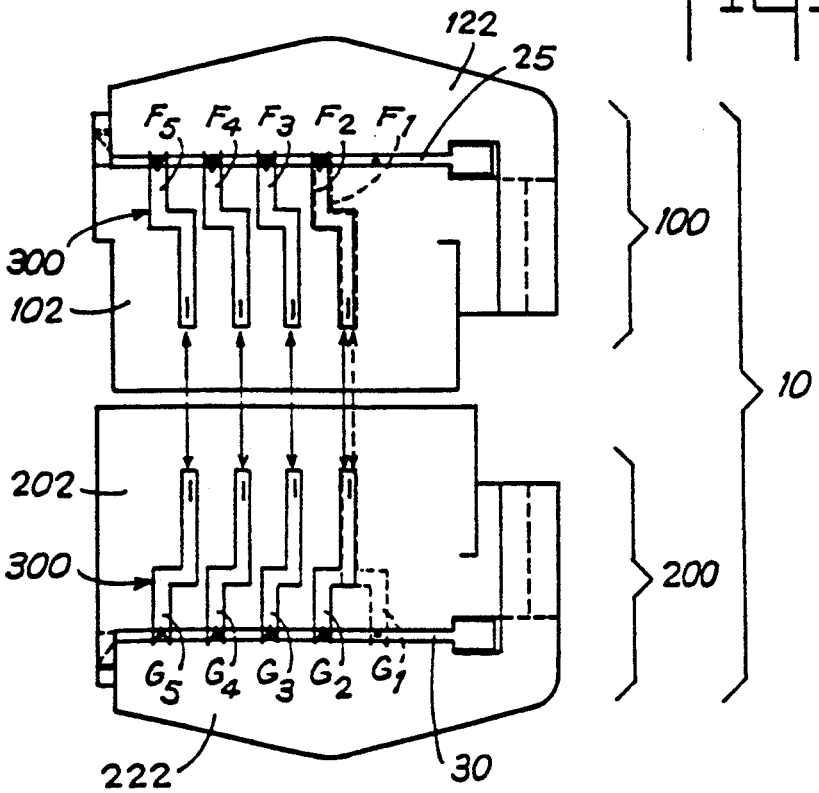
FIG. 10 is a diagrammatical section of the connection assembly.

As FIG. 10 indicates, conductors $C_5$, $C_4$, $C_3$ and $C_2$ are connected, to themselves respectively via contacts $F_5$, $F_4$, $F_3$ $F_2$ and $G_5$, $G_4$, $G_3$ and $G_2$ of the two clips, whereas conductors $C_1$ and $C_2$ will be short-circuited via contacts $F_1$ and $G_1$.

We claim:

1. Electrical connection assembly between a control bundle of n conductors and at least one branched bundle of n conductors, one at least of the conductors of the branched bundle being connected in parallel with one of the conductors of the control bundle and two of the conductors of the branched bundle being connected in series with one of the conductors of the control bundle, wherein said assembly comprises a first clip for fastening and connection on the control bundle, which clip is equipped with at least one contact ensuring an electrical contact with the conductor of the control bundle to be connected in parallel, at least one disconnection member for disconnecting the conductor to be connected in series and at least two contacts for ensuring electrical contacts on either side of the disconnection member with the conductor of the control bundle which is to be connected in series with the two of the conductors of the branched bundle, and a second clip for fastening and connection on the branched bundle, said clip being equipped with contacts each one of which is designed to ensure an electrical contact with one of the conductors of the branched bundle.

2. Assembly according to claim 1, wherein said first and second clips comprise complementary engageable members.

3. Assembly according to claim 2, wherein the contacts in each clip comprise a head with sharp ends protruding from said face of the base, and an end extending in said engageable members.

4. Assembly according to claim 1, wherein each one of the clips comprises a base having a face adapted to contact with the bundle and with contacts with insulation piercing means projecting from said face, and a cover having a face adapted to contact with the bundle and with means of fastening it on said base.

5. Assembly according to claim 4, wherein said disconnection member is integral with the base of the first clip.

6. Assembly according to claim 5, wherein said disconnection member and said base are made of insulating material.

7. Assembly according to claim 4, wherein said contact heads and ends are offset of a distance equal to half the distance separating the bundle conductors.

8. Assembly according to claim 7, wherein the cable ribbons have an extra thickness border.

9. Assembly according to claim 1, wherein the bundles are constituted by cable ribbons with parallel multi-conductors.

10. Assembly according to claim 9, wherein the clips comprise steps for receiving said extra thickness border.

11. Assembly according to claim 10, wherein the first clip comprises on a first row, a number of contacts equal to $n-2$ and on the second row only one contact opposite one of the contacts of the first row, the disconnection member being placed between said two contacts.

12. Assembly according to claim 1, wherein the contacts in each one of the clips are arranged in two parallel rows.

13. Assembly according to claim 12, wherein the second clip comprises on its second row a number of contacts equal to $n-1$ and on the second row only one contact offset with respect to the others.

* * * * *